US007823526B2

(12) United States Patent
Julnes

(10) Patent No.: US 7,823,526 B2
(45) Date of Patent: Nov. 2, 2010

(54) FOLDABLE CONE

(75) Inventor: Jon Julnes, Snohomish, WA (US)

(73) Assignee: Vanguard ADA Systems of America, Inc., Snohomish, WA (US)

( * ) Notice: Subject to any disclaimer, the term of this patent is extended or adjusted under 35 U.S.C. 154(b) by 106 days.

(21) Appl. No.: 12/253,680

(22) Filed: Oct. 17, 2008

(65) Prior Publication Data

US 2009/0235860 A1 Sep. 24, 2009

Related U.S. Application Data

(60) Provisional application No. 61/070,696, filed on Mar. 24, 2008.

(51) Int. Cl.
*E01F 9/012* (2006.01)

(52) U.S. Cl. ..... 116/63 C; 116/63 P

(58) Field of Classification Search ..... 116/63 R, 116/63 P, 63 C, 63 T; 40/124.14, 124.15, 40/124.16, 610, 612; D10/109
See application file for complete search history.

(56) References Cited

U.S. PATENT DOCUMENTS

| | | | | | |
|---|---|---|---|---|---|
| 2,282,280 | A | * | 5/1942 | Yogg | 40/124.15 |
| 2,869,504 | A | * | 1/1959 | Andrews | 116/63 P |
| 2,881,662 | A | * | 4/1959 | Harris | 248/472 |
| 2,935,238 | A | * | 5/1960 | Koehler | 116/63 P |
| 2,975,905 | A | * | 3/1961 | Foland | 40/124.15 |
| 2,991,699 | A | * | 7/1961 | Murray, Sr. | 116/63 R |
| 3,195,255 | A | * | 7/1965 | Toulmin, Jr | 40/124.15 |
| 3,322,093 | A | * | 5/1967 | Goland | 116/63 R |
| 5,090,349 | A | * | 2/1992 | Wilson | 116/63 C |
| 5,915,852 | A | * | 6/1999 | Rogers | 40/612 |
| 6,199,504 | B1 | | 3/2001 | Freeman | |
| 6,651,367 | B1 | * | 11/2003 | Barragan | 40/610 |
| 6,776,117 | B2 | * | 8/2004 | D'Onofrio | 116/28 R |
| 7,325,345 | B2 | * | 2/2008 | Hailo | 40/610 |
| D598,798 | S | * | 8/2009 | Tsui | D10/109 |

FOREIGN PATENT DOCUMENTS

| | | | | |
|---|---|---|---|---|
| CN | 201420244 | Y | * | 3/2010 |
| GB | 2148360 | A | * | 5/1985 |
| GB | 2274478 | A | | 7/1994 |
| GB | 2346403 | A | | 8/2000 |
| JP | 07229114 | A | * | 8/1995 |
| JP | 10-1918 | A | | 1/1998 |
| KR | 20-0262245 | Y1 | | 1/2002 |
| KR | 10-2006-57460 | B1 | | 12/2006 |
| WO | WO 2009007695 | A1 | * | 1/2009 |

OTHER PUBLICATIONS

Depiction of a warning cone available for sale as early as Mar. 23, 2007.

International Search Report and Written Opinion dated May 25, 2009, issued in corresponding PCT/US2008/084977, filed Nov. 26, 2008.

* cited by examiner

*Primary Examiner*—R. A. Smith
(74) *Attorney, Agent, or Firm*—Christensen O'Connor Johnson Kindness PLLC

(57) ABSTRACT

The foldable warning cone (10) is formed from paper, thin plastic, fabric, or a combination thereof, and includes two tapered side panels (12) and a base panel (14). The base panel (14) extends between the lower edges (34) of the side panels and includes a central folding seam (16), which allows the base panel to be folded upward so that the cone can collapse into a very thin configuration.

22 Claims, 5 Drawing Sheets

FOLDABLE CONE

CROSS-REFERENCE TO RELATED APPLICATION

The present application claims the benefit of provisional application No. 61/070,696, filed Mar. 24, 2008, the specification of which is incorporated herein.

BACKGROUND

The present invention pertains to a foldable warning cone that is usable at any number of locations as a visible alert to passers-by. Frequently, warning cones are placed on roads to mark a change in traffic flow, such as the merging of lanes or the temporary closure of a lane, or to indicate construction in a lane or along side of a road. Warning cones are also used to indicate a closed or inaccessible section of a sidewalk or other walkway or to warn to pedestrians of a hazardous condition. Additionally, warning cones are also commonly used indoors, for example, to denote a closed area such as a restroom or to indicate a dangerous condition such as a slippery floor. Also, the warning cones can be used to cordon off a suspected or actual crime scene or a location where a fire or accident has occurred. It is advantageous for warning cones to be easily seen and readily moveable. Traditional warning cones are constructed out of plastic or rubber.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The invention relates to a foldable cone having two side panels, tapered in the upward direction, and a base panel wherein the base panel folds along a folding seam extending along its the central portion generally parallel to the lower edges of the side panels. The two tapered side panels of the foldable cone have upper edges and lower edges and are tapered such that the width of the side panel upper edges is from ¼ to ½ the width of the side panel lower edges. Additionally, the width of the side panel lower edges is from ⅓ to ½ the height of the cone. The side panels can be "treated" by crimping or depressing along the length of the side panels to stiffen the side panels or otherwise increase their structural integrity. The upper end portions of the side panels attach together. The base panel may be folded along the foldable seam in an upwards direction. When so folded, the foldable cone is substantially flattened into a planar configuration for efficient transport and/or storage.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

While illustrative embodiments have been illustrated and described, it will be appreciated that various changes can be made therein without departing from the spirit and scope of the invention.

The present invention pertains to a foldable warning cone 10 that is usable at any number of indoor and outdoor locations to provide a visible warning to passers-by. Such usage can occur at a construction, repair or maintenance site, for a road, building, sidewalk, parking lot, etc. Other locations may include a crime scene, site of an accident, or a fire site. The foldable warning cone 10 may also be used indoors to indicate a dangerous condition such as a slippery floor or as an indicator of a closed or off-limits area such as a restroom, walkway, escalator, or section of a hall, stadium or the like. The present invention may also be used by motorists that must stop their vehicles along a road, highway or street due to, for example, mechanical problems or running out of gasoline. In short, the present invention may be utilized anywhere that warning cones, flares, or similar warning devices are employed. The present invention has the advantage over standard rigid cones in that the present invention is foldable so as to occupy very little volume for convenient shipment or storage, is easily "erected" for use, and after use may be refolded for subsequent use or disposed of. Also, the present invention does not present a fire danger in the manner of roadside flares.

Figure 1:
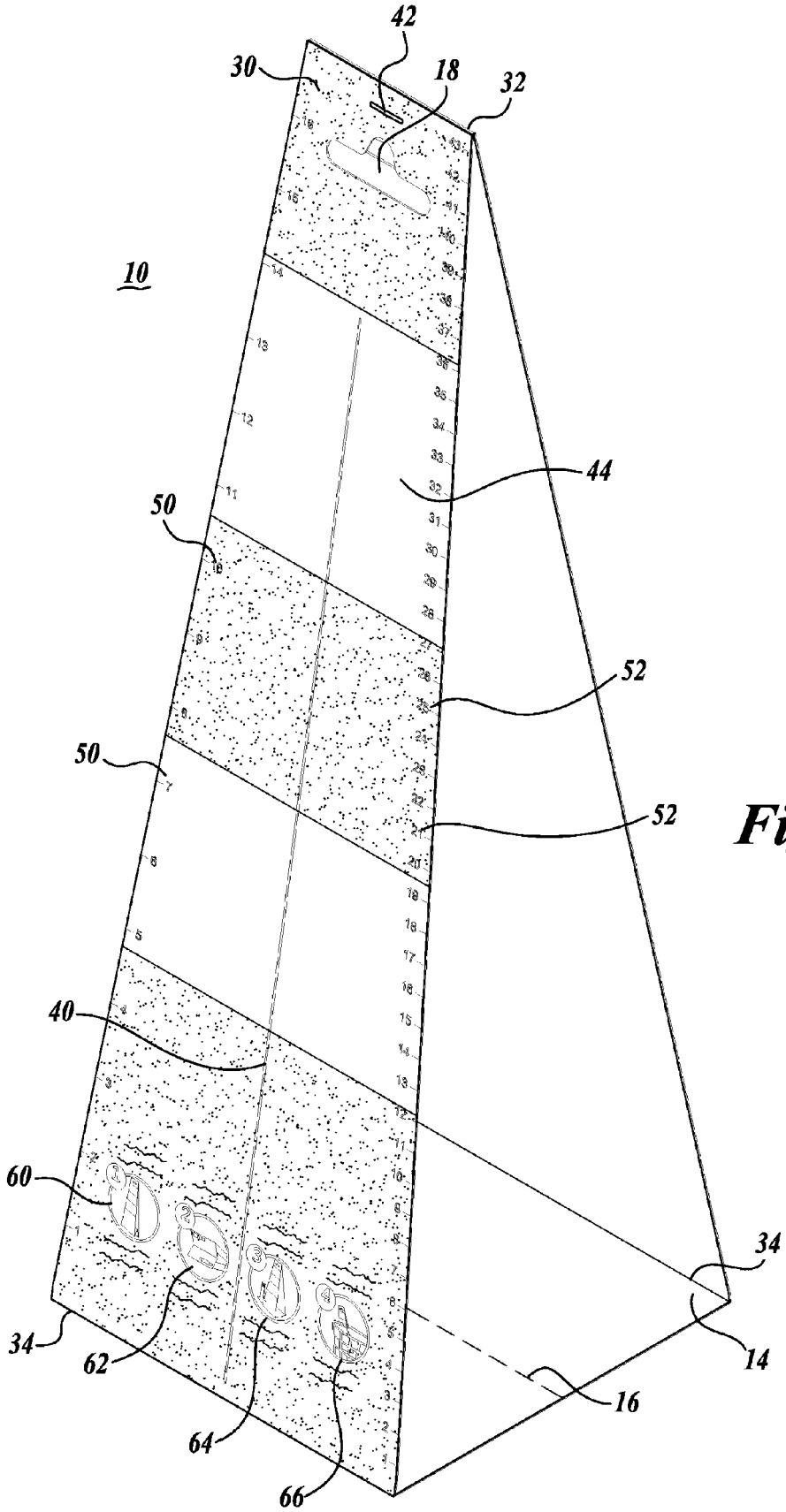
FIG. 1 is a perspective view of one embodiment of the foldable cone, shown fully deployed, with flat base surface.
Figure 2:
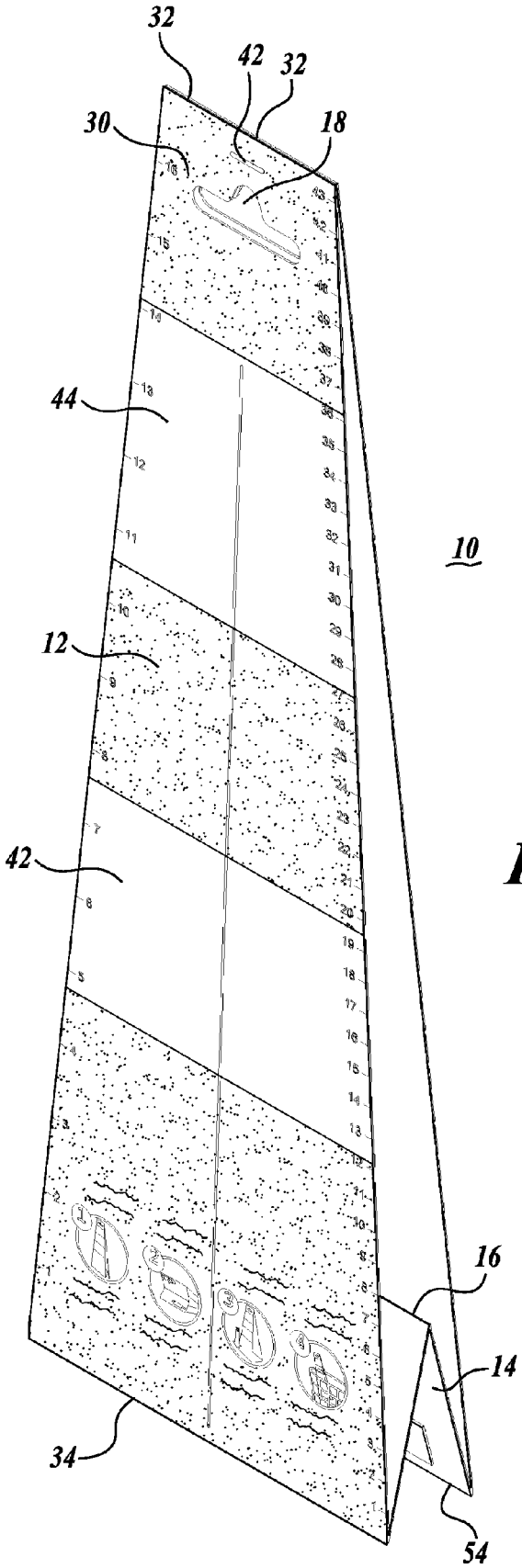
FIG. 2 is a perspective view of one embodiment of the foldable cone, illustrating the cone in folded configuration.

FIG. 1 is a perspective view of one embodiment of the foldable cone 10 showing the cone fully deployed, in its upright, or standing, position. In construction, the foldable cone 10 of the present invention includes two tapered side panels 12 and a base panel 14. The tapered side panels have upper end portions 30, upper edges 32, and lower edges 34. The base panel 14 extends between the lower edges 34 of the two side panels 12 and includes a folding seam 16 extending along the central portion of the base panel in the direction generally parallel to the lower edges 34 of the side panels. As shown in FIG. 2, the folding seam 16 allows the base panel 14 to fold upwardly to enable the cone to collapse into a very thin configuration.

Figure 5:
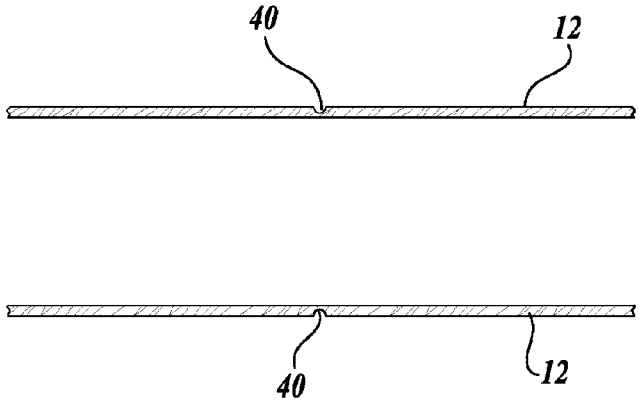
FIG. 5 is a cross-sectional view of FIG. 4, taken along lines 5-5 thereof.

As shown in FIGS. 1 and 5, a crimp or indentation 40 along a longitudinal central line can be formed in the side panels 12 by pressing against the panel. This crimp or indentation imparts increased stiffness and structural rigidity to the side panels. Although one crimp/indentation line 40 is shown, more than one line can be utilized. Applicant has found that the crimp/indentation can significantly increase the useable life of the cone, especially in rain or other wet weather, wherein the side panels if made of paper remain rigid for a significantly longer period of time than if not "treated" with the crimp/indentation.

Figure 4:
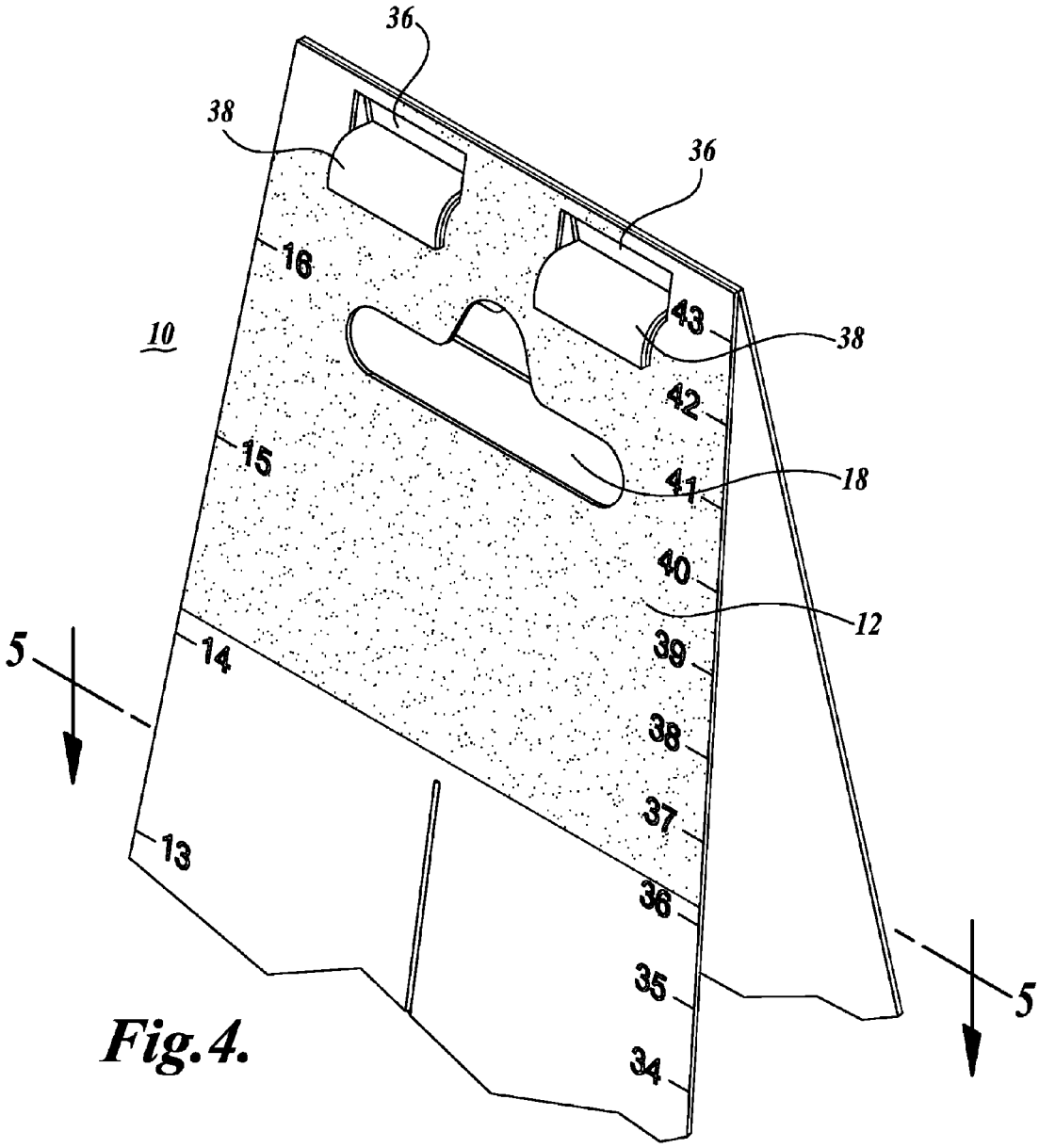
FIG. 4 is a cut away view of one embodiment of the foldable cone, showing attachment of the side panels by insertion of tabs into corresponding slots.

The upper end portions 30 of the side panels 12 are attached together by stapling, gluing, or any other means including other adhesion means. FIG. 1 illustrates the side panels attached by stapling 42. Alternately, as shown in FIG. 4, one side panel is formed with one or two tabs 38 that engage into a corresponding slot or slots 36 formed in the second side panel, thereby securing the side panels 12 together.

A central slot 18 is formed in the upper portion 30 of the side panels to serve various functions. For example, the slot can be used to engage over a rod or arm in a store display or rack. The slot can also be used to receive banner tape that can be strung between cones to, for example, "rope off" an area.

As shown in the drawings, the base panel 14 may be substantially squared in shape when in an extended position, see FIG. 1. However, the base may also take other shapes as its width and length are altered. That is, the width of the base, the dimension spanning between the lower edges 34 of the side panels 12, may be shorter or longer than the length of the base, the dimension extending along the lower edges 34 of each of the two side panels 12.

Figure 3A:
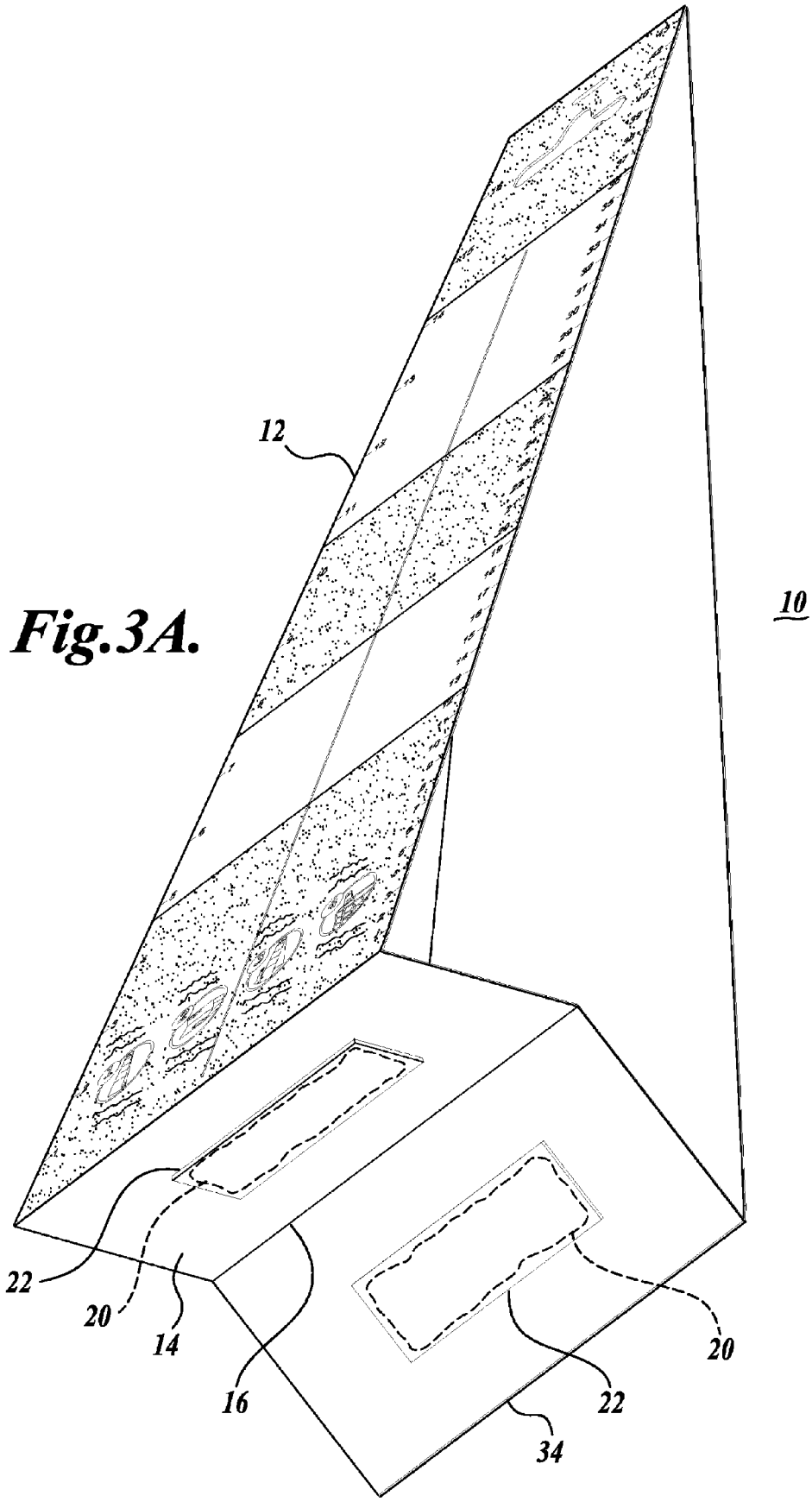
FIG. 3A is a perspective view of one embodiment of the foldable cone, showing the bottom or base.
Figure 3B:
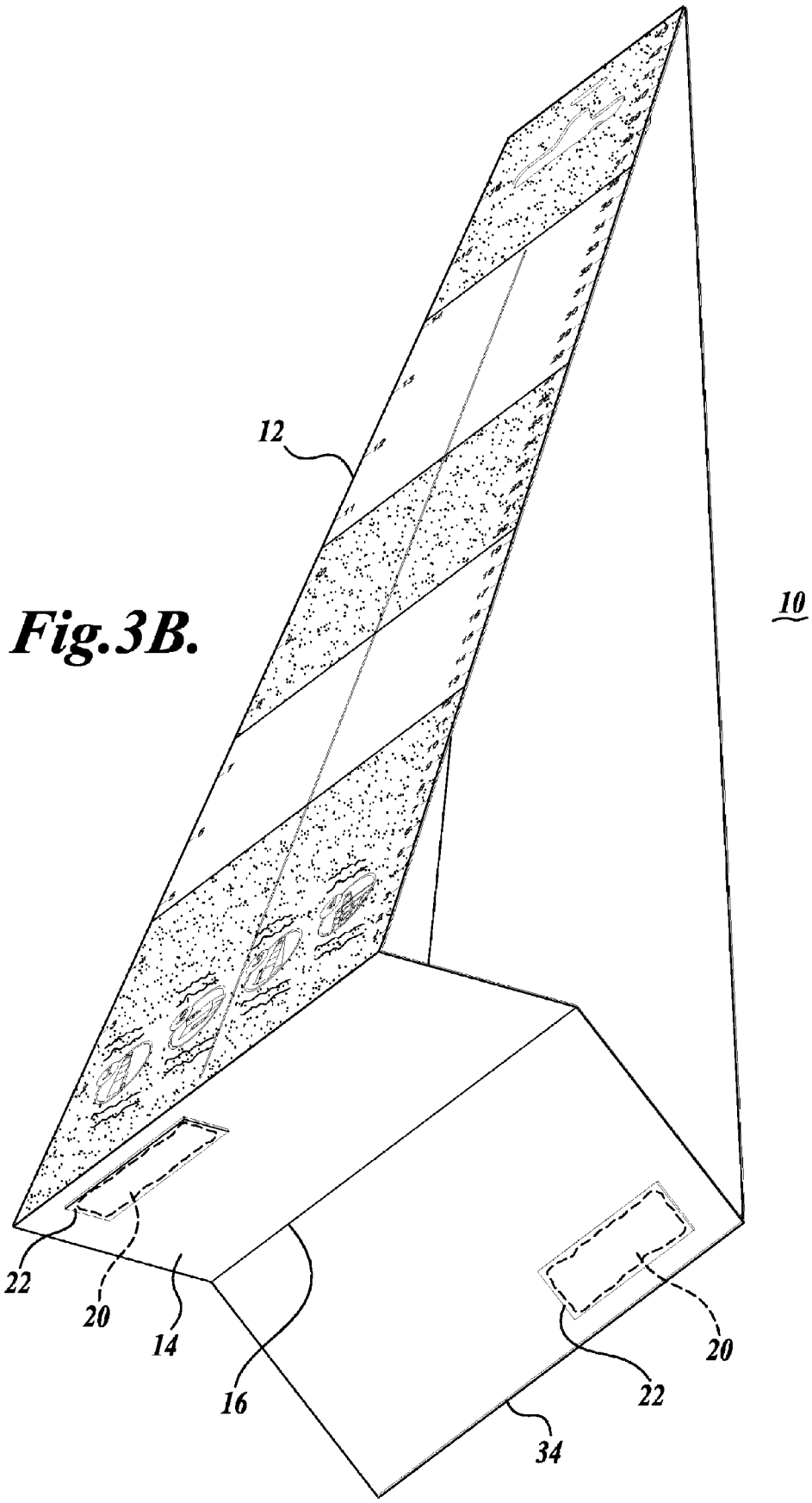
FIG. 3B is a perspective view of one embodiment of the foldable cone showing the bottom or base.

Referring to FIG. 3A, an adhesive material 20 may be placed on the underside of the base panel 14 to restrain the cone from moving once placed in a desired location. The adhesive 20 is shown as applied in two strips, one on each of the two subpanels of the base. The adhesive may be of any appropriate composition, such as of an asphalt, tar, or butyl material composition, of a tacky polymeric composition, etc. A removable peel strip 22 may be placed over the adhesive strips 20 for convenient removal when the cone 10 is positioned in a desired location. The peel strip 22 prevents the two adhesive strips from sticking together when the base panel 14 is in folded position. Of course, the adhesive can be positioned at other locations under the base panel; for example, along the perimeter or in the center of the base underside, or on the entirety of the base panel underside. If placed along the perimeter adjacent the lower edges 34 of the side panels, the strips 20 can be positioned at opposite ends of the base, as shown in FIG. 3B, so that the strips do not overlap each other when the base panel 14 is folded. In this manner, the folded warning cone is thinner than if the strips overlap each other. This allows more cones to be shipped or stored per given volume. In addition to or as an alternative to the adhesive 20, a weight may be placed on the base panel to help prevent movement of the cone 10. Such weight can be any item that is handy, such as a rock or piece of wood. Also, it will be appreciated that use of adhesive 20 enables the cone 10 to be mounted on sloped surfaces or even vertical or near vertical surfaces.

The foldable cone may be composed of various materials. One preferable material is paper. For durability, the paper can have a "slick" exterior finish so as to be water-repellant. This finish may be of a plastic, wax or other water-resistant composition. A range of different weights of paper can be used, from industrial, high-weight paperboard to lighter weight paper which is still rigid enough to stand upright. By constructing the side panels from paper, the side panels are able to flex somewhat if subjected to wind, thereby being less likely to topple over than if constructed from substantially rigid material. Also, when erected, the folding cone 10 is substantially hollow so that side winds will simply flow through the hollow interior of the cone. The cone 10 can be constructed from other materials, such as a plastic or relatively rigid fabric. These materials may be water repellant and/or water resistant.

Rather than being constructed from a single sheet of paper material, the foldable cone can be composed of multi-layered paper. Moreover, the foldable cone can be composed of a sandwich construction wherein an interior layer might be composed of thin fabric, plastic, or even of metallic or foil material, thereby to significantly increase the structural integrity of the foldable cone.

It will also be appreciated that the side panels 12 of the cone 10 taper in the upward direction. The width of the upper edges 32 of the side panels 12 is preferably from one-quarter to one-half the width of the lower edges 34 of the side panels 12. This adds to the stability of the structure, especially in the wind, since there is less area for the wind to impact against at the upper portion of the cone, thus reducing the force that could cause the cone to tip over.

The exterior of the foldable cone can be of various colors. Typically the color would be that of a traditional cone. Such color might be yellow, orange, red, or green, for example. Also, the color might be fluorescent in order to be more visible in low light or at night. Alternatively or in addition, the material comprising the cone may be reflective, such as reflective paper or plastic, or have reflective sections, for example, portions of the cone may be painted with reflective paint or may bear reflective stickers or decals.

Further, the exterior surfaces of the side panels 12 may be printed with a warning indicia. Such indicia might include the words "Warning," "Crime Scene," "Danger," "Wet Surface," or "Wet Paint," for example. Alternatively or in addition, strips of a contrasting color may be printed, placed, or painted on the cone side panels 12 to improve the visibility of the cone. For example, the cone may be red or orange, or other color, with white stripes that are positioned vertically, horizontally, or diagonally.

In FIG. 1 the stripes are shown as horizontal. Also, sections 44 of the exterior of the cone, or the entire exterior of the cone, may be white in color or of a light enough color shade so that crime scene numbers or other information might be written on the cone with an appropriate pen or other type of writing instrument, such as a pen sold under the trademark Sharpie®.

As most clearly shown in FIG. 1, indicia 50 may be applied along the side edges of the side panel 12 to indicate the height of the side panel. Such indicia might be along one or both sides of the side panel. Moreover, the indicia 50 might be in inches along one side and different indicia 52 in metric measurements along the other side of the side panel. Such indicia would be helpful when photographs are taken at the location of the foldable cone, for instance, at a crime scene, accident scene, fire scene, etc. Such indicia provides a reference with respect to size measurements in such photographs. This eliminates the need for investigators to utilize an ad hoc size reference in the photographs, for example, a pen or pencil.

Also as most clearly shown in FIG. 1, visual instructions can be provided with respect to the proper use of the foldable cone. As shown in FIG. 1, four illustrations 60, 62, 64 and 66 are provided in this regard. Illustration 60 shows how the foldable cone is to be opened. Illustration 62 indicates that the peel strips 22 are to be removed. Illustration 64 indicates that pressure is to be applied to the base of the cone so as to cause the adhesive 20 to secure the base to the surface. Illustration 66 indicates that the cone is to be properly disposed of after usage has been completed. In addition to the visual illustrations, instructions in writing can be provided adjacent each illustration. The instructions can be in multiple languages, such as English, Spanish, French, etc. Such instructions can be in one language above the illustration and a further language below the illustration. Moreover, illustrations 60, 62, 64, and 66 might be used on both of the side panels 12, in which case the illustrations on one side panel can be in a different language than the illustrations on the other side panel. In this manner, the foldable cone can be truly used universally.

The cone 10 may be of various sizes depending on usage. The height of the cone—the distance from the folding seam 16 of the base panel 14 to the upper edges 32 of the side panels—may be as short as perhaps 12 to 15 inches, or as tall as perhaps two to three feet. The width of the lower edges 34 of the cone side panels 12 may be from about one-third to one-half the height of the cone to provide sufficient stability for the cone, especially when used in exterior or outdoor applications. As mentioned previously, the width of the upper edges 32 of the side panels may be from one-quarter to one-half of the width of the lower edges 34 of the side panels.

In storage and shipment, the cone 10 may be in folded position as shown in FIG. 2, thereby occupying very little volume. In use, the base panel 14 is simply flattened into a planar configuration as shown in FIG. 1. The adhesive 20 may be set relative to the floor, road surface, or other surface on which the cone is placed by simply using one's foot to press down on the upper surface of the base, which is easily accomplished since the cone is hollow. After usage has been completed, the cone may be simply lifted off its surface and the base 14 folded upwardly for storage or disposal of the cone.

It will be appreciated that foldable cone 10 provides many advantages over cones of fixed, rigid shape. For example, cones 10 are relatively inexpensive to manufacture. The cones also are relatively light in weight, decreasing the cost of shipment. Also, when not in use, the cones can be folded to very small volume, significantly reducing shipment costs and providing efficient storage. Also, the property owner or property manager at the site on which the disposable cones are used can remove the cones after use has been completed rather than requiring the law enforcement, fire department personnel, construction contractor, or other person or entity to return to the site to retrieve the cones. This can significantly reduce costs and expenses.

While preferred embodiments of the invention have been illustrated and described, it will be appreciated that various changes can be made therein without departing from the spirit and scope of the invention.

The embodiments of the invention in which an exclusive property or privilege is claimed are defined as follows:

1. A foldable cone, comprising:

a) two tapered side panels, wherein one or more crimp lines extend longitudinally along the side panels; and b) a base panel;

wherein the tapered side panels are tapered in the upward direction; wherein the side panels have lower edges; wherein the base panel includes a folding seam extending along the central portion thereof in a direction generally parallel to the lower edges of the side panels; and wherein the base panel folds along the folding seam.

2. The foldable cone of claim 1, wherein the base panel may be folded along the foldable seam in an upwards direction, and wherein when the base panel is folded, the foldable cone is substantially flattened into a planar configuration.

3. The foldable cone of claim 1, wherein the two tapered side panels have upper end portions; and wherein the upper end portions are attached together.

4. The foldable cone of claim 3, wherein the upper end portions are attached by stapling or adhesion.

5. The foldable cone of claim 3, wherein one or more tabs are formed in the upper end portion of one of the side panels; and wherein one or more tab receiving slots are formed in the upper end portion of the second side panel; and wherein the one or more tabs connectively engage with the corresponding one or more tab receiving slots to attach the upper end portions.

6. The foldable cone of claim 1, wherein the two tapered side panels have upper end portions; and wherein slots are formed in the upper end portions.

7. The foldable cone of claim 1, wherein the two tapered side panels further have upper edges; and wherein the tapered side panels are tapered such that the width of the side panel upper edges is from ¼ to ½ the width of the side panel lower edges.

8. The foldable cone of claim 1, wherein the two tapered side panels further have upper edges; wherein the distance from the folding seam of the base panel to the upper edges is the height of the cone; and wherein the width of the side panel lower edges is from ⅓ to ½ the height of the cone.

9. The foldable cone of claim 1, wherein the foldable cone is composed of a material selected from one or more of paper, plastic and fabric.

10. The foldable cone of claim 1, wherein the base panel has an underside; and wherein an adhesive material is placed on the underside of the base panel to retain the cone from moving once placed in a desired location.

11. The foldable cone of claim 10, wherein the adhesive material is covered by a removable protective strip which can be removed once the cone is positioned in the desired location.

12. The foldable cone of claim 1, wherein the exterior surfaces of the side panels are light reflective.

13. The foldable cone of claim 1, wherein the exterior surfaces of the side panels are printed with warning indicia.

14. The foldable cone of claim 1, wherein indicia are provided along the length of the side panels to indicate the length of the side panels.

15. A foldable cone, comprising:

a) two tapered side panels, wherein one or more depression lines extend along the length of the side panels to enhance the stiffness of the side panels; and b) a base panel;

wherein the two tapered side panels have upper edges and lower edges; and wherein the tapered side panels are tapered in the upward direction such that the width of the side panel upper edges is from ¼ to ½ the width of the side panel lower edges.

16. The foldable cone of claim 15, wherein the base panel includes a folding seam extending along the central portion thereof in a direction generally parallel to the lower edges of the side panels; and wherein the base panel folds along the folding seam.

17. The foldable cone of claim 16, wherein the base panel folds along the foldable seam in an upwards direction, and wherein when the base panel is folded, the foldable cone is substantially flattened into a planar configuration.

18. The foldable cone of claim 15, wherein the two tapered side panels have upper end portions; and wherein the upper end portions are attached together.

19. The foldable cone of claim 15, wherein the base panel includes a folding seam extending along the central portion thereof in a direction generally parallel to the lower edges of the side panels; wherein the distance from the folding seam of the base panel to upper edges of the side panels is the height of the cone; and wherein the width of the side panel lower edges is from ⅓ to ½ the height of the cone.

20. The foldable cone of claim 15, wherein the foldable cone is composed of one or more materials selected from paper, plastic and fabric.

21. A foldable cone, comprising:

a) two tapered side panels, wherein the tapered side panels are tapered in the upward direction; wherein the side panels have lower edges; and b) a base panel extending between the lower edges of the tapered side panels, wherein the base panel includes a folding seam extending along the central portion thereof in a direction generally parallel to the lower edges of the side panels, and wherein the base panel is foldable along the folding seam; and c) at least first and second pieces of adhesive material disposed on an underside of the base panel to retain the cone from moving once placed in a desired location, the first and second pieces of adhesive material positioned at opposite ends of the base on opposite sides of the folding seam such that the pieces of adhesive material do not overlap each other when the base panel is folded.

22. The foldable cone of claim 21, wherein one or more depression lines extend longitudinally along the side panels to enhance the stiffness of the side panels.

* * * * *